US005341991A

United States Patent [19]

Ericsson

[11] Patent Number: 5,341,991

[45] Date of Patent: Aug. 30, 1994

[54] METHOD AND APPARATUS FOR ATOMIZING LIQUIDS

[75] Inventor: Folke C. G. Ericsson, Uppsala, Sweden

[73] Assignee: Mitab Montage & Industriteknik AB, Forsbacka, Sweden

[21] Appl. No.: 44,095

[22] Filed: Apr. 6, 1993

Related U.S. Application Data

[63] Continuation of Ser. No. 772,364, Nov. 6, 1991, abandoned.

[30] Foreign Application Priority Data

Sep. 7, 1987 [SE] Sweden ..... 8703464

[51] Int. Cl.[5] ..... B05B 7/30

[52] U.S. Cl. ..... 239/8; 239/302; 239/335; 239/346; 239/428; 417/180

[58] Field of Search ..... 239/8, 419.5, DIG. 7, 239/302, 335, 341, 346, 372, 428, 419.5, 420, 422; 417/179, 180, 197

[56] References Cited

U.S. PATENT DOCUMENTS

| | | | |
|---|---|---|---|
| 1,307,875 | 6/1919 | Parker | 239/8 |
| 1,492,593 | 5/1924 | Day | 239/8 |
| 1,751,719 | 3/1930 | Uhri, Jr. | 239/8 |
| 1,978,721 | 10/1934 | Perkins | 239/590 |
| 2,746,802 | 5/1956 | Feis | 239/432 |
| 2,993,652 | 7/1961 | Curry | 239/372 |
| 3,720,482 | 3/1973 | Tell | 417/197 |
| 3,999,713 | 12/1976 | Lindsey | 239/600 |
| 4,702,415 | 10/1987 | Hughes | 239/8 |

FOREIGN PATENT DOCUMENTS

| | | | |
|---|---|---|---|
| 671072 | 4/1966 | Belgium | 239/302 |
| 872914 | 7/1949 | Fed. Rep. of Germany | 137/892 |
| 61-123455 | 10/1984 | Japan . | |
| 59-189052 | 6/1986 | Japan . | |
| 355507 | 4/1973 | Sweden . | |
| 434347 | 7/1984 | Sweden . | |

OTHER PUBLICATIONS

Patent Abstracts of Japan, vol. 9, No. 55 (M-362), Abstract of JP-59-189052, publ. Oct. 21, 1984.

Patent Abstracts of Japan, vol. 10, No. 311 (M-528), Abstract of JP-61-123455, publ. Jun. 11, 1986.

*Primary Examiner*—Andres Kashnikow

*Assistant Examiner*—Christopher G. Trainor

*Attorney, Agent, or Firm*—Bacon & Thomas

[57] ABSTRACT

A drive gas flowing into a nozzle is allowed to suck with it, by ejector action, an extraneous gaseous medium such as ambient air, the sucked-up medium entraining from a container the liquid to be atomized. The liquid is atomized as the ambient air is mixed with the drive gas flow. An apparatus for carrying out this method includes a nozzle for supplying the drive gas, the container for supplying liquid which is to be atomized, and an inlet between the container and the nozzle for supplying ambient air, or another gaseous medium, to be sucked along with and mixed with the drive gas. A portion of the container in communication with the inlet provides an outlet through which the liquid is entrained by the inrushing ambient air as it is sucked into the drive gas flow path. The flow of ambient air past the container opening to the nozzle is adjustable.

17 Claims, 3 Drawing Sheets

METHOD AND APPARATUS FOR ATOMIZING LIQUIDS

This application is a continuation of application Ser. No. 07/772,364 filed Nov. 6, 1991, now abandoned.

BACKGROUND OF THE INVENTION

The present invention relates to a method and apparatus for atomizing liquids for different purposes, e.g. forming a cooling, humidifying or spraying mist.

In the steel industry, long rows of jets are customarily used for cooling steel plates, the jets spraying water in an atomized form onto the plate. It is desirable that the water droplets are as small as possible in order to achieve the most effective cooling possible. The jets or nozzles customarily used have fine orifices, through which water is forced with the aid of compressed air at high pressure (usually about 600 kPa). This requires the use of water purified to a high degree. In spite thereof there are often still problems with the nozzles clogging, which is partly caused by the hot environment. In most cases the water is not sufficiently finely divided either. Providing the required high air pressure is also expensive in this connection.

Examples of different cooling arrangements in the prior art are disclosed in DE-A1-2804982, DE-A13523829, SE-B-355 507, US-A-3,533,261, and US-A-4,226,108.

SUMMARY OF THE INVENTION

The present invention has the object of providing an improved method and apparatus for atomizing liquid. The method and apparatus in a simpler, more effective and operationally reliable way than previously atomizes cooling water to the desired extent without using extreme air pressures, but which can also be used not only for cooling steel plates, but also for other purposes where atomizing a liquid is required, e.g. for humidifying or spreading artificial fertilizer mists in green houses or for moistening timber stocks etc.

The method and apparatus in accordance with the invention are partially based on the so-called ejector or jet pump principle (e.g. as described in "Svensk Pumpmarknad" published by EuroContact AB, 1977, pp 212–215). According to a basic concept of the invention, a drive gas (e.g. air) flowing into a nozzle is allowed to suck with it, in per se known manner by ejector action, an extraneous, gaseous medium (e.g. ambient air), the sucked-up medium being caused to entrain liquid which is sucked or forced by said ejector action into the flow path of the medium. In this way, excellent atomizing of the continuously entrained liquid in the mixed gas flow can be obtained, so that an effective liquid mist can leave the nozzle outlet.

BRIEF DESCRIPTION OF THE DRAWINGS

The invention will be described in more detail with regard to some special embodiments. Reference will be made to the accompanying drawings, where.

DETAILED DESCRIPTION OF THE PREFERRED EMBODIMENTS

Figure 1:
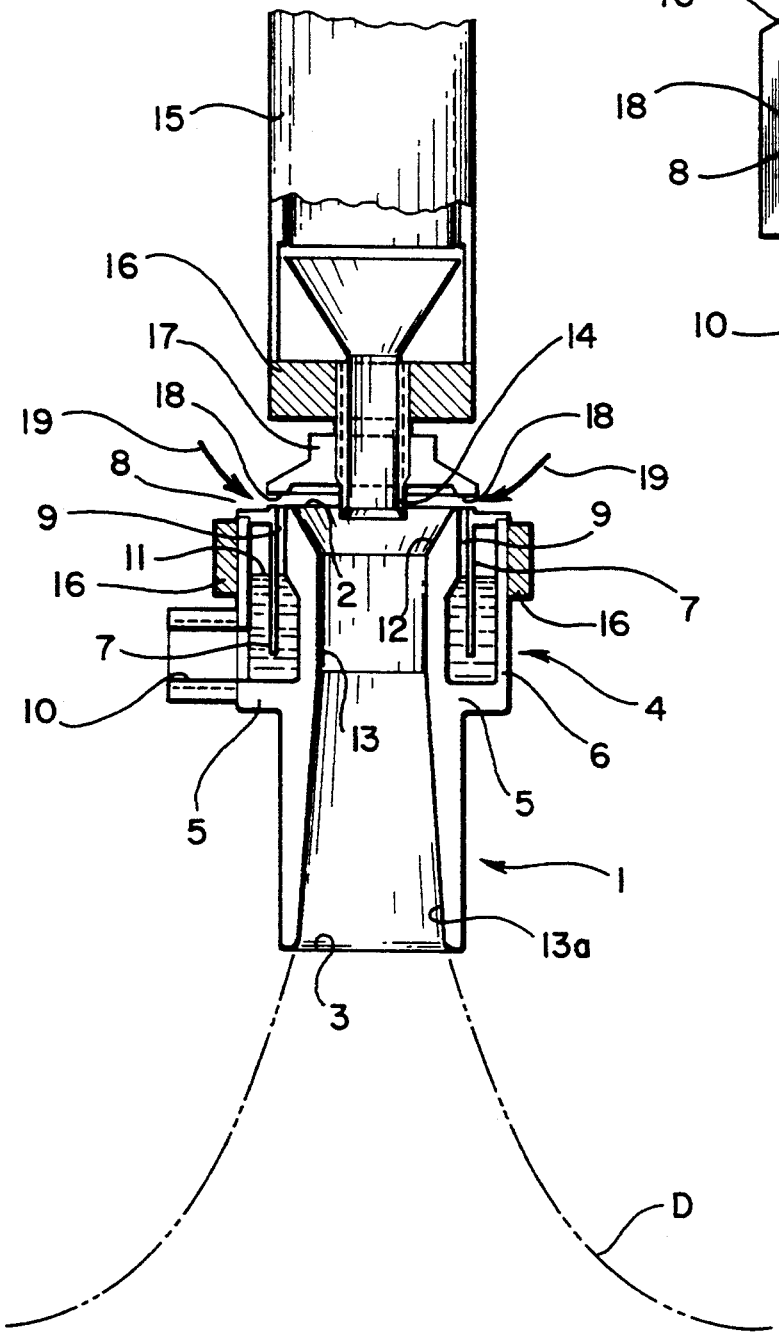
FIG. 1 is a cross-sectional view of an embodiment of a liquid atomizing apparatus in accordance with the invention, intended for spraying substantially downwards.
Figure 2:
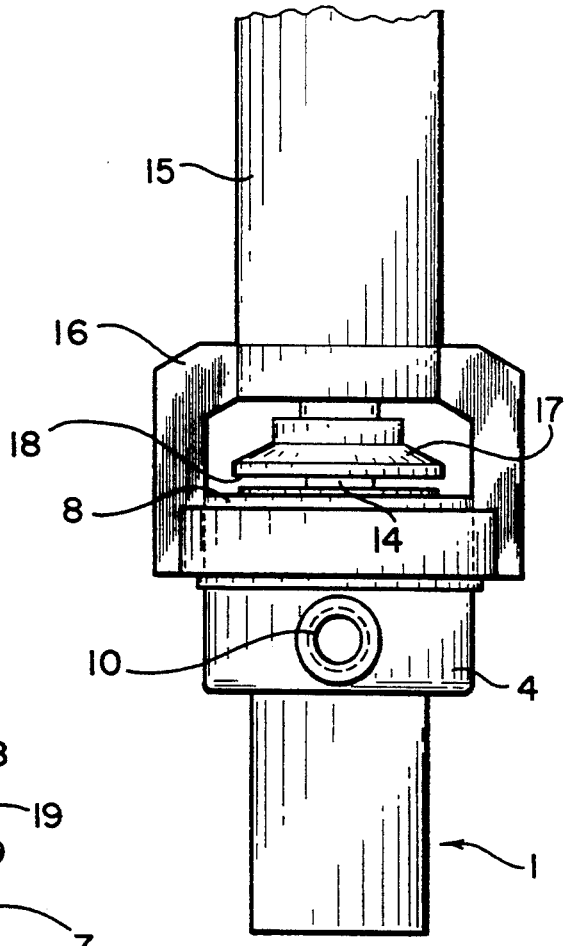
FIG. 2 is a side view of the apparatus in FIG. 1.

The liquid atomizing apparatus illustrated in FIGS. 1 and 2 includes a substantially cylindrical nozzle element 1 having an inlet opening 2 and an outlet opening 3. At its inlet part, the nozzle element 2 is surrounded by an annular container 4 for a liquid, e.g. cooling water possibly containing one or more dissolved substances, which is to be atomized and sprayed out through the nozzle element 1.

The liquid container 4 is here implemented integrally with the nozzle element 1 and is formed by a flange portion 5, from the outer edge of which a side wall 6 extends upwards, so that an annular space is defined between the upper part of the nozzle element 1 and the container wall 6. A concentric partition wall 7, extending downwards from a container partial upper part 8 towards, but not up to, the bottom of the container 4, i.e. the flange 5, divides the container 4 into two annular chambers in mutual communication in the lower part thereof. By a thickening of the nozzle element wall, the inner wall of the inner chamber, i.e. the outer wall of the nozzle element 1, has its upper portion projecting radially somewhat outwards, so that a relatively narrow, annular gap 9 is defined between the partition wall 7 and the upper part of the nozzle element. A liquid supply pipe 10 connects to the annular container 4 in its lower part. The upper part 8 of the container, this part only covering the outer annular chamber, is provided with one or more unillustrated openings to enable the outer chamber to communicate with the surrounding air pressure. By suitable means, not described in any detail here, a predetermined constant liquid level 11 is maintained in the outer chamber, and also in the inner chamber when the apparatus is in an inactive state, as will be described in more detail below.

The interior of the nozzle element 1 has a converging inlet portion 12, a tubular mixing portion 13 and a weakly converging diffuser portion 13*a*, which is terminated at the nozzle opening 3.

A jet 14 fixed in the end of a gas supply pipe 15 thrusts somewhat into the nozzle opening 2. Through the gas supply pipe 15, a gas or gas mixture such as air, nitrogen or hydrogen, desired for the purpose, can be blown in by an unillustrated apparatus such as a fan, gas container etc. The tubular part of the jet 14 projecting out from the gas supply pipe 15 is provided with threads and is threaded into the upper part of a yoke-like holder 16, the lower part of which is fixed to the outer wall of the liquid container 4.

A regulating collar 17, the bottom part of which extends radially outwards somewhat further than the partition wall 7, is threaded onto the lower, tubular part of the jet 14, so that a gap 18 is defined between the regulating collar 17 and the upper surface of the nozzle element 1. This gap will be the inlet opening for gas, e.g. ambient air, which is to be sucked into the nozzle element 1 when the apparatus is functioning, as will be described below. By virtue of the regulating collar 17 being threadedly connected to the jet 14 the gap height may be adjusted.

The liquid atomizing apparatus described above operates in the following manner. When for example air is blown through the tube 15 with the aid of a fan means, a subpressure caused by ejector action will occur in the gap 18 between the outer edge of the regulating collar and the opposing inner liquid chamber, the subpressure being adjustable by suitable adjustment of the distance between the regulating collar 17 and the nozzle opening 2. When the liquid level 11 in the liquid container 4 is suitably adjusted to this subpressure, the liquid level in the inner liquid chamber will be raised by suction into the gap space 9 and up over its upper edge, while extraneous gas is simultaneously sucked into the gap, as illustrated by the arrows 19. The extraneous gas can be the same gas as the gas supplied via the tube 15, or another gas/gas mixture, e.g. ambient air in the case illustrated. The air being sucked in will thus continuously "slice off" the protruding liquid column in the annular gap 9. The entrained liquid is mixed in the nozzle element 1 with the air blown in via the jet 14 and leaves the nozzle opening 3 in an atomized state. By suitable adjustment of the different parameters, excellent atomization of the water is achieved, so that a very homogeneous liquid mist is obtained, as indicated by the chain dotted lines D.

It will be understood that the apparatus described above has great operational reliability and may be used with a variety of fluids, including by way of example and not limitation, cooling water and gases such as air due to its relative simplicity. For purposes such as cooling, no high purification of the cooling water is required and ordinary mechanically purified water conventionally used in industry can be used. For the supply of air, no air compressing equipment is necessary and an ordinary blower apparatus giving 11–12 kPa, for example, can be used. Since the risk of clogging has been substantially eliminated, the apparatus can further operate reliably in a hot environment, which is of importance for different cooling applications.

As indicated above, the atomizing apparatus in accordance with the invention is, of course, not restricted to cooling purposes, e.g. cooling in plate rolling mills, grooved rolls, etc, but it is also excellently suited for such as humidifying or moistening purposes, e.g. binding heavy dust (such as metal oxides) in steel works, etc, for heat recovery via humidified air, for humidifying green houses, or for spreading artificial fertilizer mists in green houses (which is done today with the aid of conventional nozzles). Another field of use is moistening stored timber.

Figure 3:
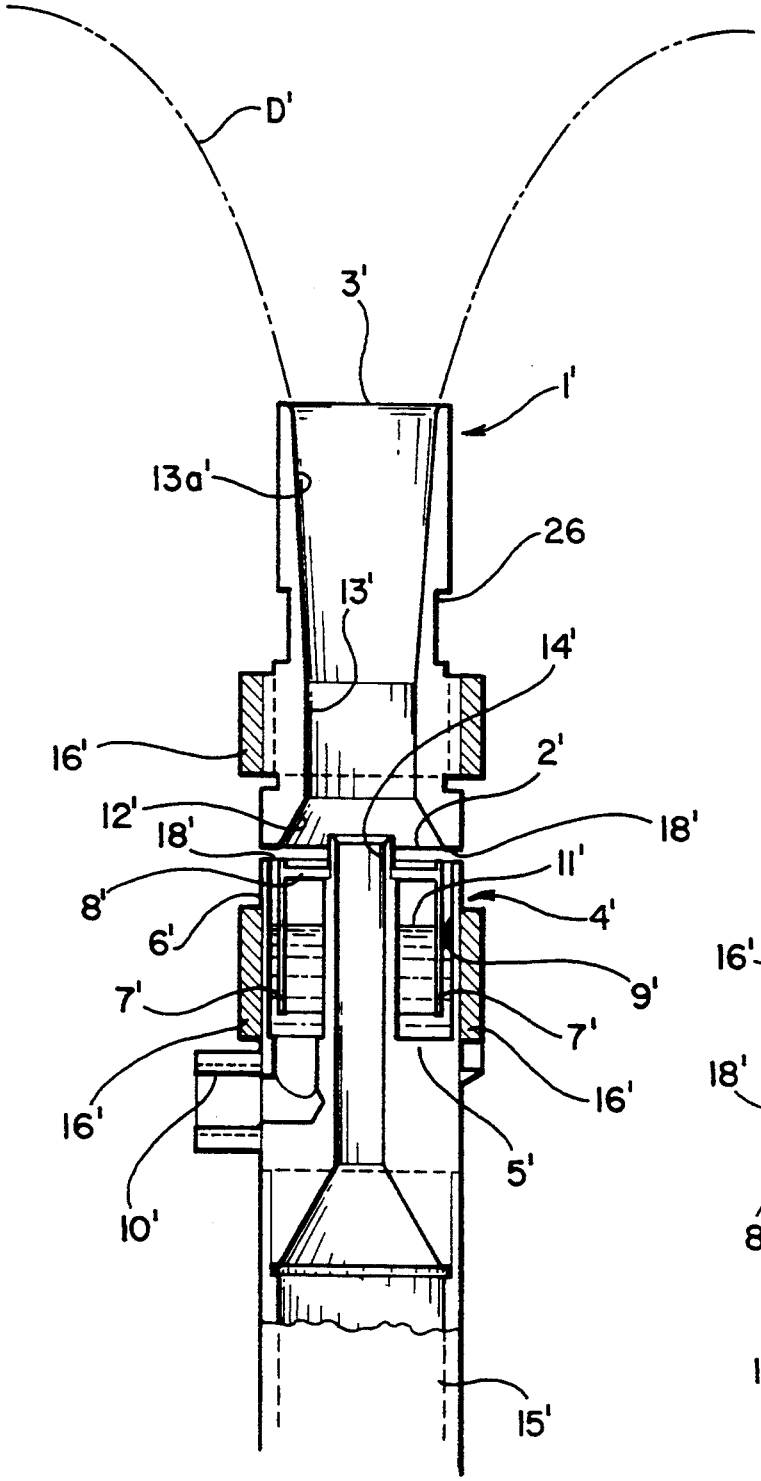
FIG. 3 is a cross-sectional view of an apparatus corresponding to the one in FIGS. 1 and 2, and intended for spraying substantially upwards.
Figure 4:
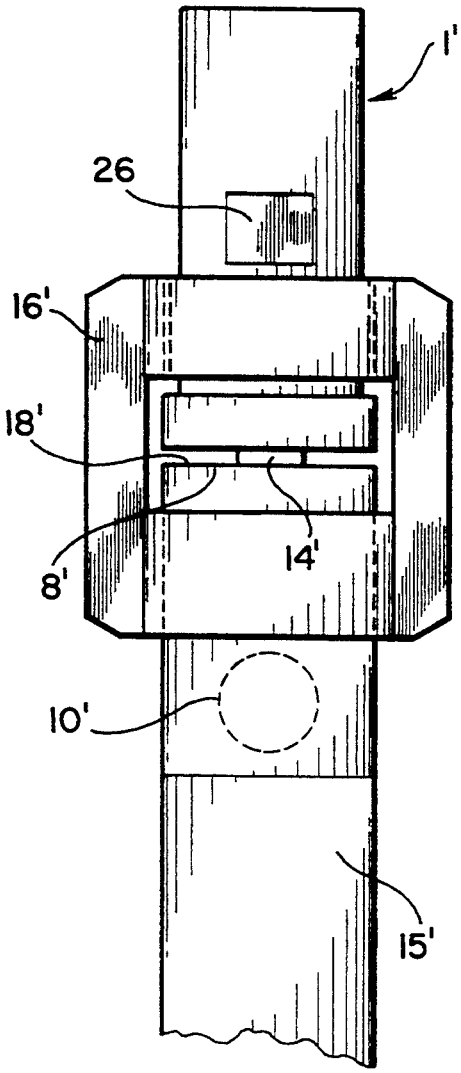
FIG. 4 is a side view of the apparatus in FIG. 3.

An apparatus corresponding to the one in FIGS. 1 and 2 is illustrated in FIG. 3, but this apparatus is intended for spraying substantially upwards, e.g. for cooling rolled plate from below. Corresponding parts are provided with the same reference numerals supplemented by a prime sign. The main difference in relation to the apparatus in FIGS. 1 and 2 is that the apparatus according to FIGS. 3 and 4 has the liquid container 4' integrated with the gas supply jet 14'. instead of the nozzle element 1. The regulating collar 17 is thus not needed, and the suction gap 18' between the upper part of the container and the nozzle opening 2' can be adjusted by the nozzle element 1' being threaded into the holder 16'. Further, the inner and outer chambers in the liquid container defined in conjunction with FIG. 1 have changed places. Numeral 26 denotes a pair of flats for a spanner.

Figure 5:
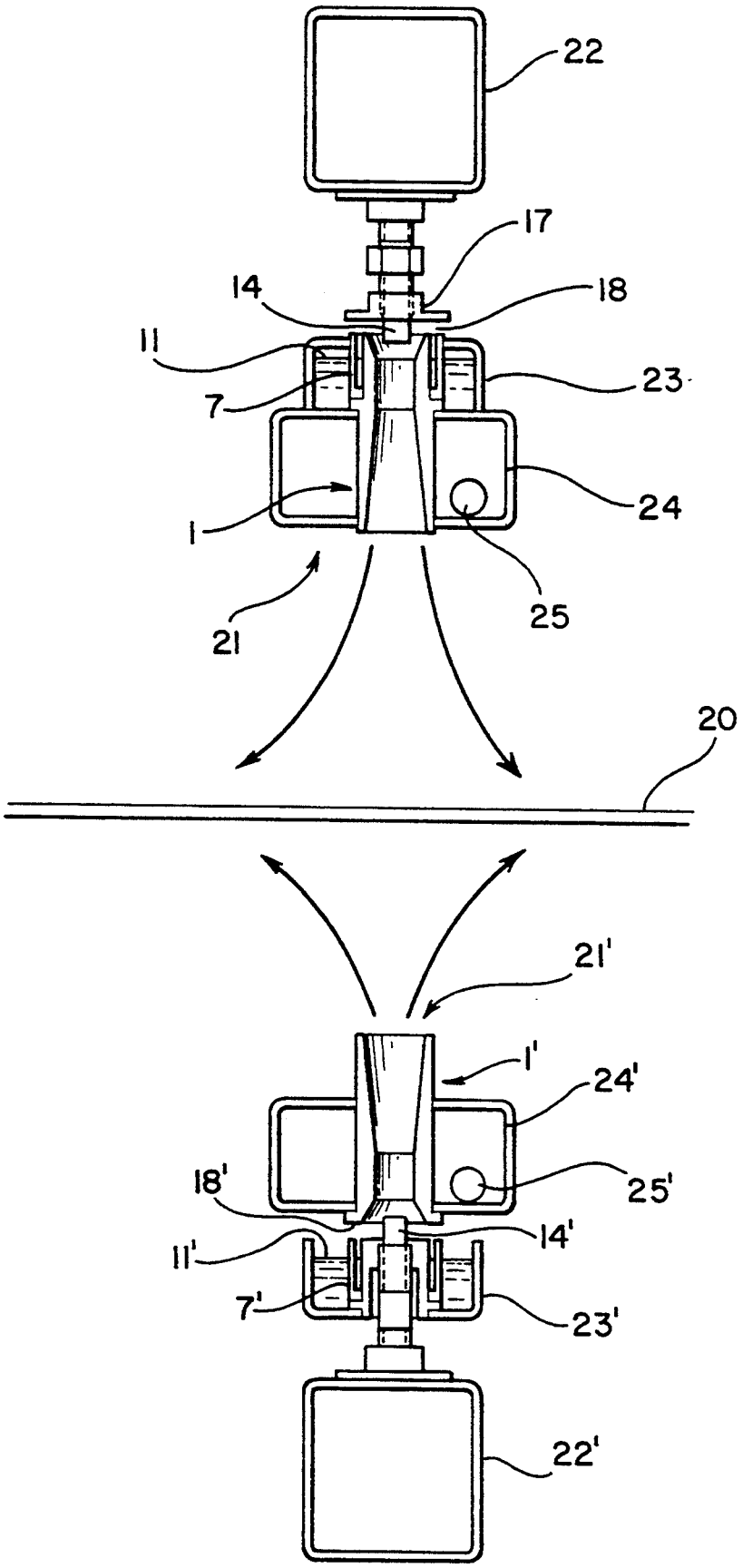
FIG. 5 is a side view of a pair of apparatuses similar to the ones in FIGS. 1 and 2, and 3 and 4, respectively, where they have been adapted for cooling a steel plate.

In FIG. 5 there are illustrated similar cooling apparatuses as those illustrated in FIGS. 1 and 2, and 3 and 4, respectively, for cooling steel plate, e.g. in a heavy plate rolling mill, corresponding parts being denoted with the same reference numerals as in FIGS. 1–4. Here, several rows of atomizing apparatuses are envisaged as being arranged transverse to the plate travel direction, FIG. 5 illustrating a cross section taken between a pair of atomizing apparatuses in a row of such apparatuses.

Thus, several rows, e.g. two, of atomizing apparatuses for spraying from above are arranged on the upper side of, and suitably spaced from, a steel plate 20 which is to be cooled, these apparatuses here being represented by one like the one according to the FIGS. 1 and 2, and generally denoted by the reference numeral 21. In a corresponding way, apparatuses for spraying from below are arranged on the underside of the plate 20, these apparatuses being represented by one like the one according to FIGS. 3 and 4, and generally denoted by the reference numeral 21'. The upper spray apparatuses 21 are connected to a common air duct 22, and in a similar way the lower spray apparatuses 21' are connected to a common air duct 22'. In the embodiment illustrated here, the outer chamber in FIGS. 1–4 is, however, not concentric with the partition wall 7, 7', but this chamber is formed by a common duct 23 for the upper apparatuses, which duct extends on the upper side of a similarly common cooling box 24, the apparatuses 21, without an outer chamber and with appropriately modified partition walls, being inserted in corresponding recesses made in the duct 23 and cooling box 24. In a corresponding way, the lower apparatuses 21' without their liquid chambers are arranged in a common liquid duct 23' and a common cooling box 24' spaced therefrom. The cooling boxes 24, 24', which are intended to protect the apparatuses 21, 21', from the heat of the steel plate 20, are provided with cooling water via inlets 25 and 25' in the box ends. There is achieved in accordance with the arrangement outlined in FIG. 5 excellent cooling of the rolled plate due to the extremely effective cooling mist obtained by the atomizing apparatuses in accordance with the invention.

In the embodiments described above, atomizing apparatuses have been illustrated which are intended for spraying either substantially upwards and downwards, For angled spraying, e.g. with 30°–40° inclination of the nozzles, the apparatuses must be modified, e.g. by suitable oblique implementation of the liquid containers/suction parts of the apparatuses. Alternatively, a suitable guide plate could be sufficient. Necessary modifications for different applications can readily be accomplished by one skilled in the art.

The invention is, of course, not restricted to embodiments described above and especially illustrated, and many variations and modifications are possible within the scope of the inventive concept and the following claims.

I claim:

1. A method of atomizing a liquid, comprising the steps of:

causing a first gaseous medium to be sucked into and mixed with a flowing second gaseous medium with a mixing area by means of an ejector action; and causing the first gaseous medium to entrain a liquid medium, said liquid medium being caused by said ejector action to be sucked, along with the first gaseous medium from outside the mixing area into the flow path of the second gaseous medium to thereby mix the liquid medium with, and atomize the liquid medium in, the first and second gaseous media within the mixing area.

2. A method as claimed in claim 1, wherein said first gaseous medium and said second gaseous medium comprise the same gaseous material.

3. A method as claimed in claim 2, wherein said gaseous media comprise air.

4. A method as claimed in claim 1, wherein said liquid medium is at least substantially water.

5. A method as claimed in claim 2, wherein said water contains at least one dissolved substance.

6. A method as claimed in claim 1, further comprising the step of using the atomized liquid for cooling purposes.

7. A method as claimed in claim 1, further comprising the step of using the atomized liquid for humidifying purposes.

8. A method as claimed in claim 1, further comprising the step of using the atomized liquid for moistening purposes.

9. An apparatus for atomizing a liquid, comprising gaseous drive medium supply means for supplying a gaseous drive medium to a nozzle element, liquid supply means for supplying liquid which is to be atomized, inlet means for permitting a second gaseous medium to be sucked in by, and mixed with, the drive medium within a mixing portion of said nozzle element as a result of an ejector action caused when the drive medium passes through the nozzle element, said liquid supply means comprising a container means located outside of the mixing portion of said nozzle element, said container means including an at least partially opened upper part in communication with a flow path of said second gaseous medium for causing liquid in the container means to be caused by said ejector action to successively rise above the container means upper part and into said flow path and to be continuously entrained by said second gaseous medium and atomized in the mixture of gaseous media.

10. An apparatus as claimed in claim 9, wherein said container means comprises two mutually communicating chambers, a space above a surface of the liquid in a first of said two chambers communicating with an incoming flow path of said second gaseous medium, a space above a surface of the liquid in the second of said two chambers communicating with surroundings of said apparatus.

11. An apparatus as claimed in claim 10 wherein said liquid supply means maintains a constant liquid level in the second chamber.

12. An apparatus as claimed in claim 10, wherein said first chamber extends substantially concentric to the flow path of the drive medium, and wherein said apparatus further comprises inlet means for permitting and second gaseous medium to flow in a substantially radially inward direction over said chamber and into the nozzle element.

13. An apparatus as claimed in claim 13, wherein said first and second chambers are each defined by a common partition wall.

14. An apparatus as claimed in claim 13, wherein said partition wall is annular.

15. An apparatus as claimed in claim 12, wherein said inlet means defines a gap between said container means and said means for supplying a gaseous drive medium, and further comprising adjustment means for adjusting said gap.

16. An apparatus as claimed in claim 15, wherein said adjustment means comprises a regulating collar between said gaseous drive medium supply means and said nozzle element.

17. An apparatus as claimed in claim 15, wherein said adjustment means comprises a jet threaded into a yoke in said gaseous drive medium supply means.

* * * * *